US009592455B2

(12) United States Patent
Tiefel et al.

(10) Patent No.: US 9,592,455 B2
(45) Date of Patent: Mar. 14, 2017

(54) SYSTEM AND METHOD OF PROVIDING POSABLE FEATURE CONTROLS IN A TOY

(71) Applicant: Creative Things, LLC, Springdale, AR (US)

(72) Inventors: Simeon E. Tiefel, Springdale, AR (US); Keith Scheffler, Springdale, AR (US)

( * ) Notice: Subject to any disclaimer, the term of this patent is extended or adjusted under 35 U.S.C. 154(b) by 0 days.

(21) Appl. No.: 14/947,296

(22) Filed: Nov. 20, 2015

(65) Prior Publication Data

US 2016/0144285 A1 May 26, 2016

Related U.S. Application Data

(60) Provisional application No. 62/082,188, filed on Nov. 20, 2014.

(51) Int. Cl.

| | |
|---|---|
| ***A63H 3/36*** | (2006.01) |
| ***A63H 3/48*** | (2006.01) |
| ***A63H 3/20*** | (2006.01) |
| ***A63H 13/00*** | (2006.01) |

(52) U.S. Cl.

CPC ..... *A63H 3/365* (2013.01); *A63H 3/20* (2013.01); *A63H 3/48* (2013.01); *A63H 13/005* (2013.01)

(58) Field of Classification Search

USPC ..... 446/100, 321, 337, 338, 339, 340, 391, 446/395

See application file for complete search history.

(56) References Cited

U.S. PATENT DOCUMENTS

| | | | | |
|---|---|---|---|---|
| 3,406,482 | A * | 10/1968 | Ryan | A63H 13/005 446/304 |
| 3,745,696 | A | 7/1973 | Sapkus et al. | |
| 3,828,469 | A * | 8/1974 | Giroud | A63H 13/005 446/337 |
| 3,841,020 | A * | 10/1974 | Ryan | A63H 3/24 446/190 |
| 5,584,741 | A * | 12/1996 | Cheung | A63H 3/28 40/414 |
| 5,800,242 | A * | 9/1998 | Clokey | A63H 3/04 446/337 |
| 6,110,001 | A * | 8/2000 | Chae | A63H 3/31 446/183 |
| 6,544,094 | B1 * | 4/2003 | Maddocks | A63H 3/48 446/175 |

(Continued)

*Primary Examiner* — Kurt Fernstrom

(74) *Attorney, Agent, or Firm* — LaMorte & Associates, P.C.

(57) ABSTRACT

A toy head assembly with facial features that can be adjusted by touching the facial features with enough force to alter their shape and/or position. Within the toy head assembly is a head base that is surrounded, in part, by a face that is made of an elastomeric material. Facial features on the face are supported, in part, by posable elements that lay under the elastomeric material of the face. Each posable element extends from the interior head base at a different ball and socket joint. Each posable element also has a post that extends from the ball and socket joint. The post contacts the interior surface of the face, wherein movement of a post alters a point of contact between the post and the face within the contact area. Changes in the point of contact cause changes in the contours of the face. This alters the facial features.

18 Claims, 4 Drawing Sheets

(56) References Cited

U.S. PATENT DOCUMENTS

| | | | | |
|---|---|---|---|---|
| 6,733,359 | B1 * | 5/2004 | Jacobs | A63H 3/28 446/300 |
| 6,793,553 | B2 * | 9/2004 | Willett | A63H 3/40 446/301 |
| 7,207,859 | B1 * | 4/2007 | Iaconis | A63H 3/40 446/330 |
| 7,837,531 | B2 * | 11/2010 | Friedland | A63H 3/28 446/298 |
| 8,998,672 | B2 * | 4/2015 | Lin | A63H 13/005 446/268 |
| 2008/0014831 | A1 | 1/2008 | Rettberg et al. | |

* cited by examiner

SYSTEM AND METHOD OF PROVIDING POSABLE FEATURE CONTROLS IN A TOY

RELATED APPLICATIONS

This application claims priority of provisional patent application No. 62/082,188, filed Nov. 20, 2014.

BACKGROUND OF THE INVENTION

1. Field of the Invention

In general, the present invention relates to toys that have posable features, such as movable facial features. More particularly, the present invention relates to mechanisms used to manually manipulate such posable features.

2. Prior Art Description

Many toys, such as dolls and puppets, have heads with facial features. The facial features are typically molded and/or painted into fixed positions.

As such, the facial features of the toy remain constant. However, with more sophisticated dolls and puppets, certain facial features, such as the eyes and mouths can be manipulated into different positions. In this manner, at least some of the facial features can be selectively altered by the person playing with the toy.

In early designs, dolls and puppets had eyes that were set behind holes in the eye sockets of the head. The eyes were attached to levers that could be moved up and down or side to side in order to change the orientation of the eyes. Facial features like the mouth were made adjustable by using a hinge at the jaw. In this manner, the jaw could be made to open and close. However, since the jaw was made with a hinge, the jaw had visible hinge lines. These hinge lines detracted from the aesthetics of the toy and made the doll or puppet seam less realistic.

In more modern designs, the heads of dolls and puppets have been molded as a shell of elastomeric material. This enables facial features of the toy to be selectively altered in shape without having to use hinge lines or other cuts in the apparent skin of the toy. Since the apparent skin of the toy is made from a flexible material, mechanisms can be positioned below the skin that adjusts the positions and contours of the facial features. Such prior art is exemplified by U.S. Pat. No. 3,745,696 to Sapkus and U.S. Patent Application Publication No. 2008/0014831 to Rettberg et al.

As indicated by the patents cited above, some prior art dolls have elastomeric skin and adjustable facial features that are adjusted by mechanisms under the elastomeric skin. A problem that exists in such prior art dolls is that once a particular facial feature is set into a position by a person, that facial feature often inadvertently changes. The changes are often caused by tensions in the elastomeric skin of the toy. This is especially true if the toy has a thick rubber skin or if the material being used for the skin is particularly resilient. Over time, the tension in the skin pulls at the underlying mechanisms, therein causing features to change appearance. The only prior solution to this problem is to make the facial features highly resistant to movement. However, this has the adverse affect of making the toy difficult to adjust during play.

A need therefore exists for a toy having adjustable facial features, wherein the toy has elastomeric skin, yet the resiliency of the skin does not cause inadvertent changes in the facial features.

This need is met by the present invention as described and claimed below.

SUMMARY OF THE INVENTION

The present invention is a toy head assembly with eyes and facial features that can be selectively adjusted by pressing or otherwise touching the facial features with enough force to alter their shape and/or position. Within the toy head assembly is a head base that cannot be directly observed. The head base is surrounded by the exterior of the toy head. The exterior of the toy head includes the face of the toy head. The face is made of an elastomeric material. Facial features are formed on the exterior surface of the face.

The facial features are supported in part by posable elements that lay under the elastomeric material of the face. Each posable element extends from the interior head base at a different ball and socket joint. Each posable element also has a post that extends from the ball of the ball and socket joint. The post contacts the interior surface of the face, wherein movement of a post about its ball and socket joint alters a point of contact between the post and the face within said contact area. Changes in the point of contact cause changes in the contours of the face. This alters the facial features.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy with feature posing system can be embodied in many ways, the embodiment illustrated shows the system being used in the head of a Shrek® doll. This embodiment is exemplary and presents a simple configuration of the invention that is useful for description and understanding. The illustrated embodiment, however, is merely exemplary and should not be considered a limitation when interpreting the scope of the appended claims.

Figure 1:
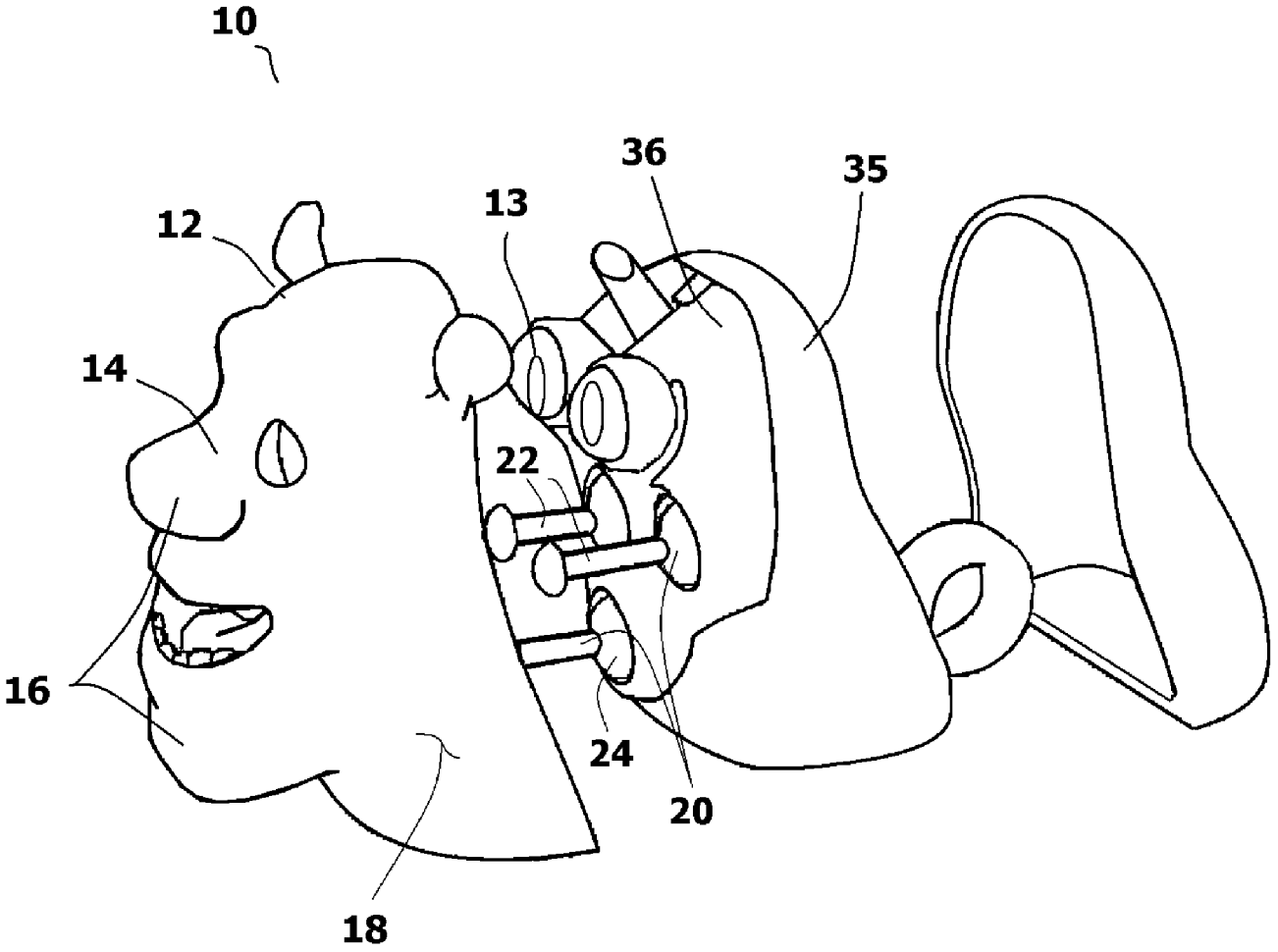
FIG. 1 is a perspective, partially exploded view of an exemplary embodiment of a toy having adjustable facial features.
Figure 3:
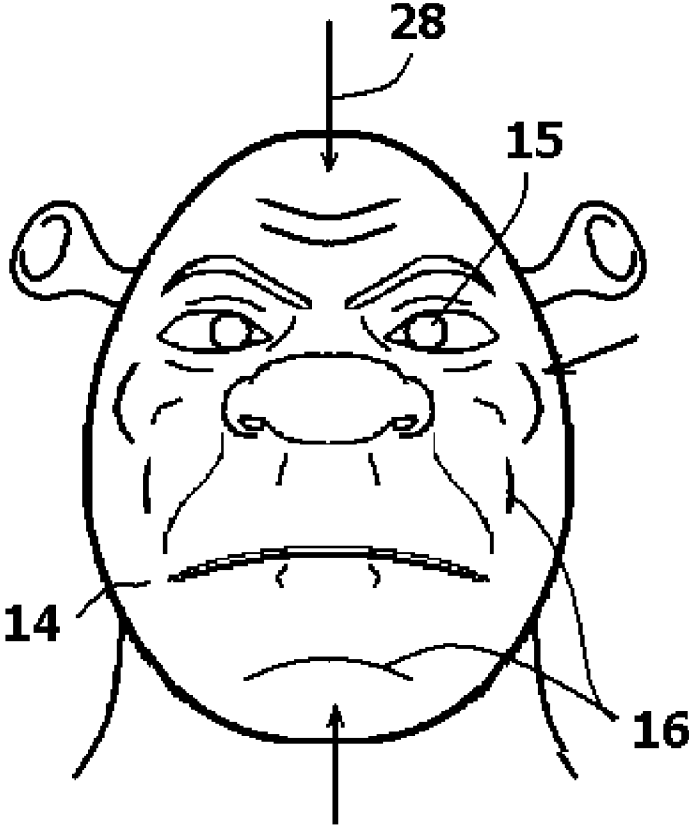
FIG. 3 is a front view of the exemplary embodiment of FIG. 1 with the face configured in a second expression.
Figure 2:
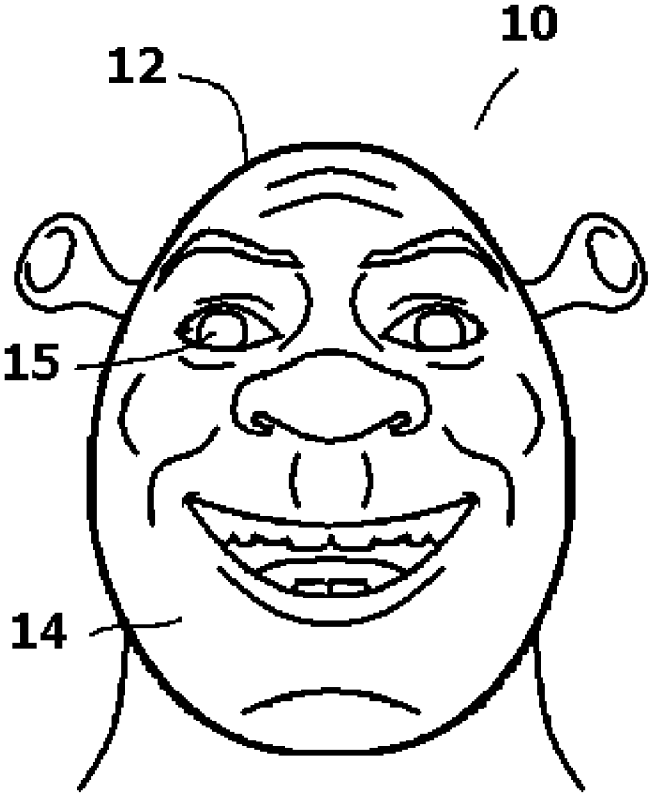
FIG. 2 is a front view of the exemplary embodiment of FIG. 1 with the face configured in a first expression.

Referring to FIG. 1 in conjunction with FIG. 2 and FIG. 3, a head 12 of a toy 10 is shown. The head 12 can be a toy bust, the head of a doll, or the head of a puppet. The head 12 has a face 14. The face 14 has eyes 15 and various other facial features 16. The eyes 15 and at least some of the facial features 16 are posable. The facial features 16 may include the nose, ears, cheeks, jaw, mouth and brow. In the shown embodiment, a simplified head 12 is illustrated that has adjustable eyes 15 and adjustable facial features 16 that include the eyes, cheeks, jaw and brow. Since the eyes 15 and facial features 16 are posable, a person can physically manipulate the eyes 15 and facial features 16 into different configurations. Thus, the expressions of the eyes 15 and the facial features 16 on the face 14 can be changed as desired.

The face 14 of the head 12 is preferably molded from elastomeric material 18. However, flexible fabric can also be used. With the exception of the eyes 15, a posing element 20 is provided for each of the facial features 16. Each posing element 20 consists of a post 22 that extends from a specialized ball and socket joint. Each post 22 has an enlarged head 26 which contacts the interior of the elastomeric material 18 of the face 14, therein distorting the face 14 to some degree. The use of the ball and socket joints 24 enable the position of the posts 22 to be selectively altered throughout a contact area. The contact area is determined by the range of motion provided to the posts 22 by the ball and socket joints 24.

In FIG. 2, the face 14 is shown with the eyes 15 and facial features 16 configured in a happy, smiling configuration. In FIG. 3, the same face 14 is shown angry. The change in eyes 15 and facial features 16 is created by manually moving the eyes 15 and pressing on the face 14 in the direction of the force application arrows 28. This manual force moves the posts 22 under the elastomeric material 18 of the face 14, therein causing the facial features 16 to change.

Figure 4:
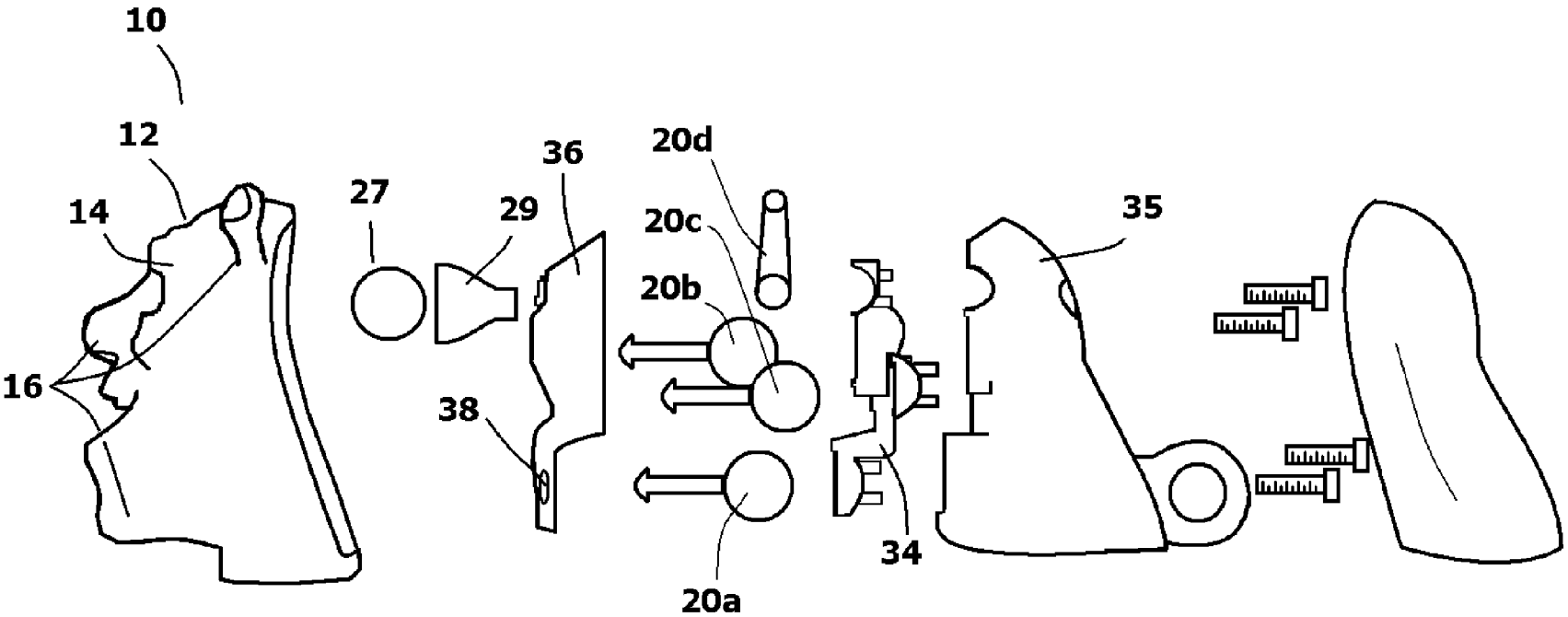
FIG. 4 is a side, fully exploded view of the exemplary embodiment of FIG. 1.

Referring to FIG. 1 in conjunction with FIG. 4, it can be seen that a posing element 20a is provided for the jaw. Two separate posing elements 20b, 20c are provided for the cheeks. Another posing element 20d is provided for the brow. Furthermore, each eye 15 is independently posable. As a result, the eyes 15 and each of these facial features 16 and be manually altered independently of all the other facial features 16. As such, a near infinite number of facial expressions can be created by adjusting the eyes 15 and the facial features 16 in different combinations.

Figure 5:
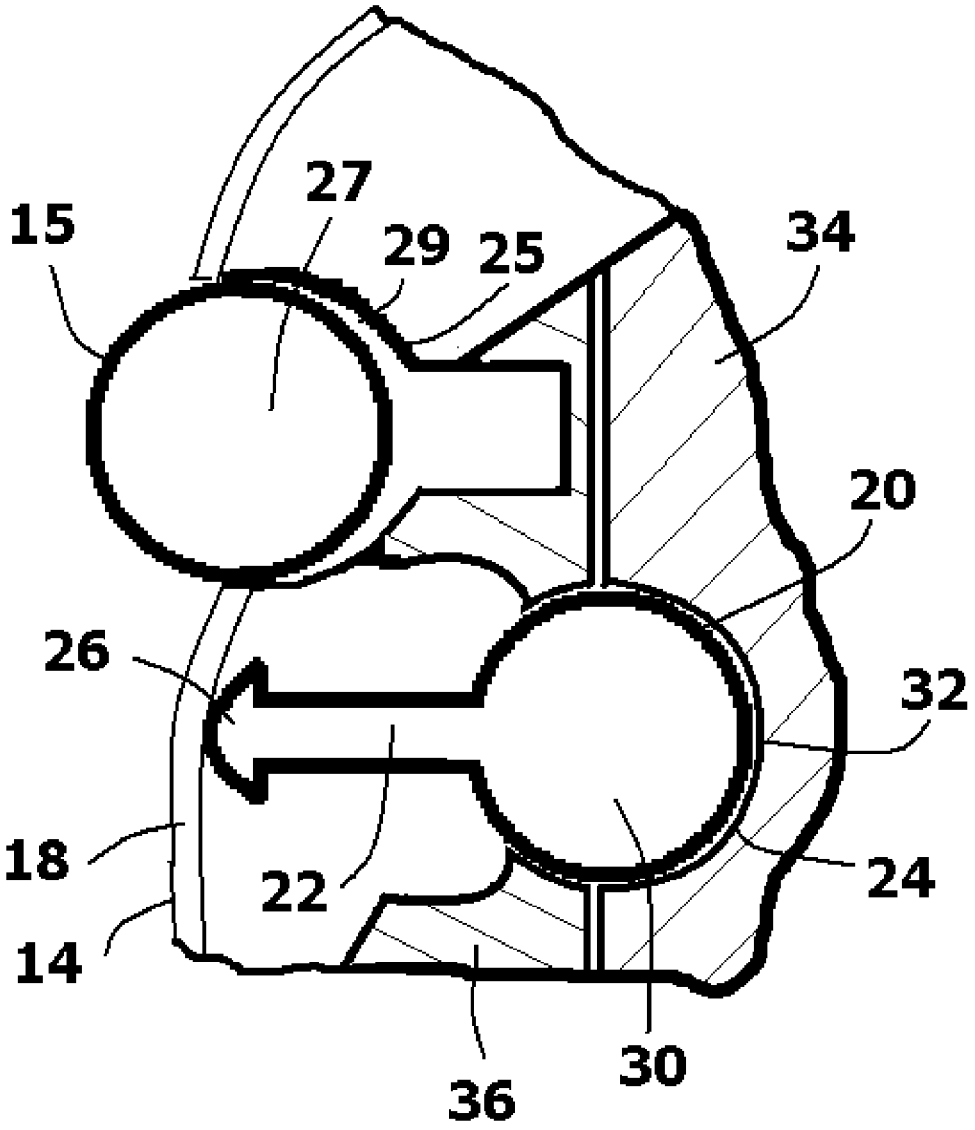
FIG. 5 is a cross-sectional view of a ball and socket joint within the exemplary embodiment.

Referring to FIG. 5 in conjunction with FIG. 4 and FIG. 1, it will be understood that each posing element 20 utilizes a ball and socket joint 24. Each ball and socket joint 24 is created by the mating of a ball 30 with a socket 32. The ball 30 is smooth hard plastic. The ball 30 has a post 22. The post 22 is a protrusion that extends from the ball 20 and contacts the rear of the face 14. Each post 22 terminates with its enlarged head 26 so as not to create a pointed protrusion through the material of the face 14.

Similarly, each eye 15 consists of a ball 27 that engages a socket 29 to form a ball and socket joint 25. No posts extend from the ball 27 of the eye 15. Rather, the eye 15 is molded or painted to appear as an eyeball.

The ball 30 of each posing element 20 is seated in a socket 32. The ball 27 of the each eye 15 is seated in a socket 29. Each ball 27, 30 is preferably molded of a hard plastic. Likewise, each socket 29, 32 is molded from a synthetic rubber, silicon or some other relatively soft elastomeric material that has a high coefficient of friction in contact with the plastic of the plastic of the balls 27, 30.

The head 12 is internally supported by a head base 35. A socket base 34 connects to the head base 35. All of the sockets 32 for the posing elements 20 are molded into the socket base 34. As such, the socket base 34 is molded from the elastomeric material required of all the sockets 32. Alternatively, the head base 35 itself can be molded of the high-friction elastomeric material, wherein the head base 35 and socket base 34 are molded together as an integrated piece.

The balls 30 are held within the sockets 32 of the socket base 34 using a contoured faceplate 36. The contoured faceplate 36 is positioned directly behind the elastomeric material 18 of the face 14. When interposed between the socket base 34 and the contoured faceplate 36, the balls 30 of the posing elements 20 are pressed firmly against the sockets 32 of the socket base 34. The posts 22 of the posing elements 20 extend through holes 38 in the contoured faceplate 36.

Separate sockets 29 are provided for each of the balls 27 of the eyes 15. These sockets 29 attach to the contoured faceplate 36 and are supported by the contoured faceplate 36. The balls 27 of the eyes 15 are biased into the sockets 29 by the elastomeric material 18 of the face 14. The face 14 has holes for the eyes 15 that are smaller than the balls 27. Thus, the balls 27 contact both the elastomeric material 18 of the face and the sockets 29. To rotate the eyes 15, the balls 27 must be manipulated with enough force to overcome the friction with these surfaces.

To utilize the toy 10, a person can press against the face 14 to move the underlying posts 22 of the posing elements 20. Since the plastic balls 30 of the posing elements 20 are pressed into elastomeric sockets 30, a large degree of friction occurs between the plastic balls 20 and the sockets 32. This makes the posts 22 resistant to movement. Although the posts 22 can be moved by a determined manual force, the posts 22 are not moved by tensions in the elastomeric material 18 of the face 14. Consequently, once a posing element 20 is moved, it remains in that position unless intentionally moved again. Likewise, a person can directly touch the balls 27 of the eyes 15 to rotate the eyes 15. The balls 27 of the eyes 15 contact both the elastomeric material 18 of the face as well as the elastomeric material of the socket 29. As such, a significant force is required to reposition the eye 15. Once at a desired position, the contact friction holds the eye 15 in place.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A toy head assembly, comprising:

a head base;

a face of elastomeric material having an interior surface and an exterior surface, wherein a facial feature is provided on said exterior surface, and wherein said face covers at least part of said head base;

a first ball and socket joint having a first socket that is supported by said head base and a first ball that is free to rotate within said first socket; and a post that extends from said first ball and contacts said interior surface of said face within a contact area, wherein movement of said first ball within said first socket alters a point of contact between said post and said face within said contact area.

2. The assembly according to claim 1, wherein said first socket is molded from an elastomeric material that contacts said first ball, wherein a high coefficient of friction exists between said first ball and said first socket.

3. The assembly according to claim 2, further including a faceplate that attaches to said head base, wherein said faceplate biases said first ball into said first socket.

4. The assembly according to claim 3, wherein a hole is disposed through said faceplate and said post extends through said hole when said faceplate is mounted to said head base.

5. The assembly according to claim 1, further including an enlarged head that terminates said post, wherein said enlarged head contacts said interior surface of said face.

6. The assembly according to claim 1, further including an eye, wherein said eye includes a second ball set into a second socket.

7. The assembly according tom claim 1, wherein said second ball contacts said interior surface of said face and is biased into said second socket by said face.

8. A toy head assembly, comprising:

a face of elastomeric material having an interior surface and an exterior surface, wherein a facial feature is provided on said exterior surface;

a head base;

a posable element extending from said head base at a ball and socket joint, wherein said posable element contacts said interior surface of said elastomeric material within a contact area, wherein movement of said posable element alters a point of contact between said posable element and said face within said contact area, therein altering said facial feature from under said face.

9. The assembly according to claim 8, wherein said posable element includes a first ball set into a first socket, wherein a post extends from said first ball and engages said interior surface of said face.

10. The assembly according to claim 9, wherein said first socket is molded from an elastomeric material that contact said first ball, wherein a coefficient of friction exists between said first ball and said first socket sufficient to prevent inadvertent movement of said first ball in said first socket.

11. The assembly according to claim 10, further including a faceplate that attaches to said head base, wherein said faceplate biases said first ball into said first socket.

12. The assembly according to claim 11, wherein a hole is disposed through said faceplate and said post extends through said hole when said faceplate is mounted to said head base.

13. The assembly according to claim 9, further including an enlarged head that terminates said post, wherein said enlarged head contacts said interior surface of said face.

14. The assembly according to claim 8, further including an eye, wherein said eye includes a second ball set into a second socket.

15. The assembly according tom claim 14, wherein said second ball contacts said interior surface of said face and is biased into said second socket by said face.

16. A toy head assembly, comprising:

a face of elastomeric material having an interior surface and an exterior surface, wherein multiple facial features are provided on said exterior surface;

a head base;

a plurality of posable elements extending from said head base at ball and socket joints, wherein each of said posable elements contacts said interior surface of said elastomeric material proximate a different one of said plurality of posable elements, wherein movement of said plurality of posable elements physically alters said facial features.

17. The assembly according to claim 16, wherein said facial features are selected from a group consisting of a chin, cheeks, brows, mouth, nose and ears.

18. The assembly according to claim 16, wherein each of said plurality of posable elements includes a ball set into a socket, and a post that extends from said ball and engages said interior surface of said face.

* * * * *